US008528772B1

(12) United States Patent
Morris, Jr.

(10) Patent No.: US 8,528,772 B1
(45) Date of Patent: Sep. 10, 2013

(54) RECTANGULAR CONTAINER HAVING CHILD RESISTANT LID ASSEMBLY

(76) Inventor: Glenn H. Morris, Jr., Chattanooga, TN (US)

( * ) Notice: Subject to any disclaimer, the term of this patent is extended or adjusted under 35 U.S.C. 154(b) by 69 days.

(21) Appl. No.: 13/210,508

(22) Filed: Aug. 16, 2011

(51) Int. Cl.
*B65D 45/16* (2006.01)

(52) U.S. Cl.
USPC ..... 220/326; 206/506; 206/508; 206/518; 206/519; 215/216; 220/254; 220/288; 220/306; 220/323; 220/328; 220/601; 220/617; 220/771

(58) Field of Classification Search
USPC ..... 220/254, 288, 306, 323, 326, 328, 220/601, 617, 771; 206/506, 508, 518, 519; 215/216
See application file for complete search history.

(56) References Cited

U.S. PATENT DOCUMENTS 5,377,858 A * 1/1995 Morris, Sr. ..... 220/254.8

* cited by examiner

*Primary Examiner* — Anthony Stashick
*Assistant Examiner* — Elizabeth Volz
(74) *Attorney, Agent, or Firm* — Stephen J. Stark; Miller & Martin PLLC

(57) ABSTRACT

A rectangular container has a child resistant lid assembly wherein the rectangular closure is provided with an opening. The child lid assembly is preferably removably mounted on the closure to close the opening and is preferably positioned during shipment and storage to be substantially planar with the closure. The side walls of the container may be tapered to facilitate nesting with a similar container. The locking mechanism on the closure engages an exterior portion of the lid, such as at least one of a plurality of teeth in a locked configuration.

20 Claims, 4 Drawing Sheets

RECTANGULAR CONTAINER HAVING CHILD RESISTANT LID ASSEMBLY

FIELD OF THE INVENTION

The present invention relates to containers having closures with internal threaded lids, and more specifically to those containers having closures with locking members which engage stops on the lids which are internally threaded.

BACKGROUND OF THE INVENTION

Child resistant lid assemblies for open head cylindrical containers are disclosed in Applicant's U.S. Pat. Nos. 4,967,926, 5,125,538 and 7,513,384 (incorporated herein by reference) and others, wherein a threaded connection is provided between the container and lid and at least one resiliently biased locking member is pivotally connected to the lid which cooperates with locking teeth on the container to secure the lid to the container. Applicant's U.S. Pat. No. 5,377,858, incorporated herein by reference, relates to a rectangular container which the applicant believes to be an excellent product.

While these child resistant lid assemblies have been satisfactory for their intended purpose, the construction and arrangement of the lid closure, container and associated locking member resulted in the use of a significant amount of plastic material in the design shown in the '858 patent.

Furthermore, the open head containers upon which the lids and associated locking members are connected are cylindrical, thereby requiring more space for pallet loading and storage than would be required if the containers were rectangular. Rectangular containers for maximizing use of pallet space are disclosed in U.S. Pat. Nos. 2,606,586 and 3,307,739; however, these containers do not include child resistant lid assemblies. U.S. Pat. No. 5,377,858 has a child resistant lid assembly, but it provides internal teeth in the container which are engaged by a locking member on the lid which engages at least one of those teeth through the lid for the locking configuration. For at least some embodiments, at least removing that opening would be desirable, but would likely render the preferred illustrated embodiment of the '858 unworkable for its intended purpose since those teeth could then not be engaged.

SUMMARY OF THE INVENTION

In order to maximize use of pallet space for transportation and storage, a substantially rectangular container and associated child resistant lid assembly of the present invention have been devised, wherein the container may be provided with a rectangular closure snapped onto, or otherwise connected at, an upper rectangular edge of the container. The closure is preferably provided with a central circular opening surrounded by at least one annular wall having threads formed radially exteriorly thereon for engagement with cooperating internal threads on a downwardly depending exterior wall of a lid. A resiliently biased locking member pivotally may be preferably connected to the closure which may engage a stop such as one of a plurality of teeth on an outer surface of the exterior wall of the lid to secure the lid to the container closure. The lids and associated locking members can be positioned inwardly of the peripheral edges of the containers, and also preferably either be recessed to be substantially planar or below an upper elevation of the container and/or protected when the lid is installed and containers are stacked.

Short diagonal side webs may be provided along the peripheral edge portion on the bottom or top of each container for centering the container on top of the lid on the next adjacent lower container when stacking.

Hand grips may also be provided integral with two side walls of the container which are tapered to facilitate nesting of plural containers when empty, the two side walls also having longitudinally extending recesses to facilitate removing the container from the nested position.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
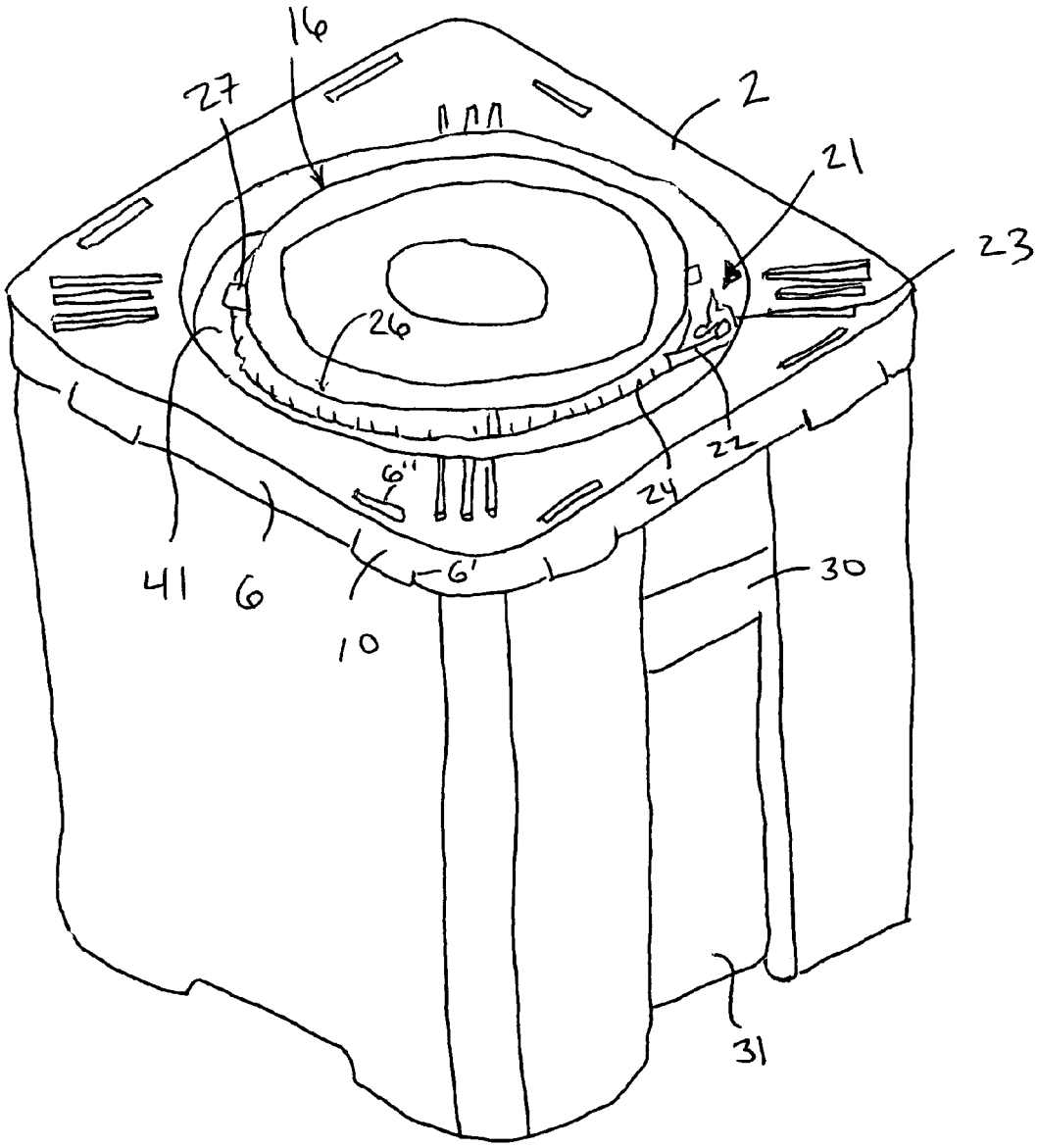
FIG. 1 is a perspective view of the container and lid assembly of the present invention.
Figure 3:
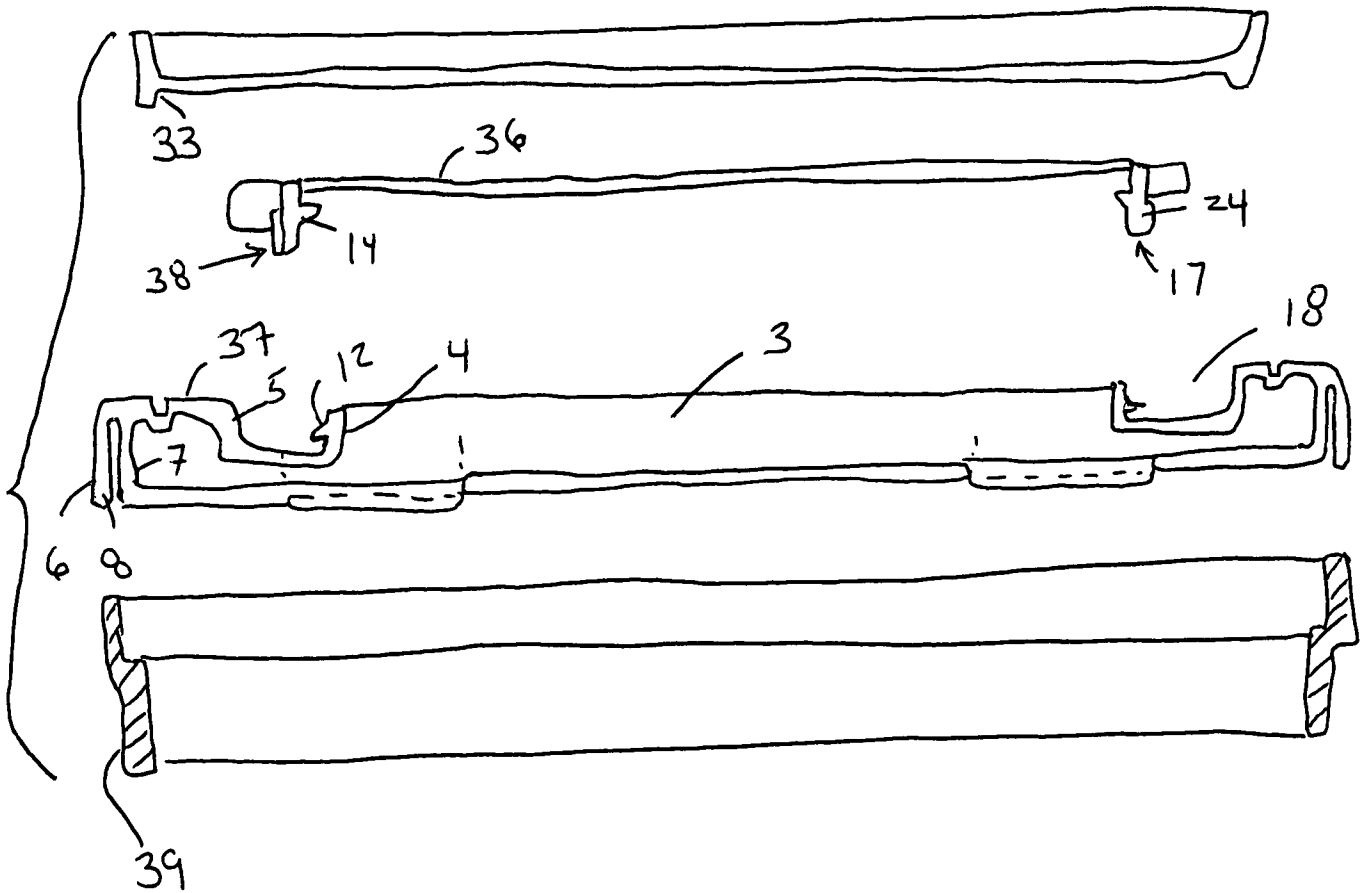
FIG. 3 is an exploded, fragmentary, sectional view showing the top edge portion of the container, the container closure, the lid and associated locking member, and the bottom of another stacked container.
Figure 5:
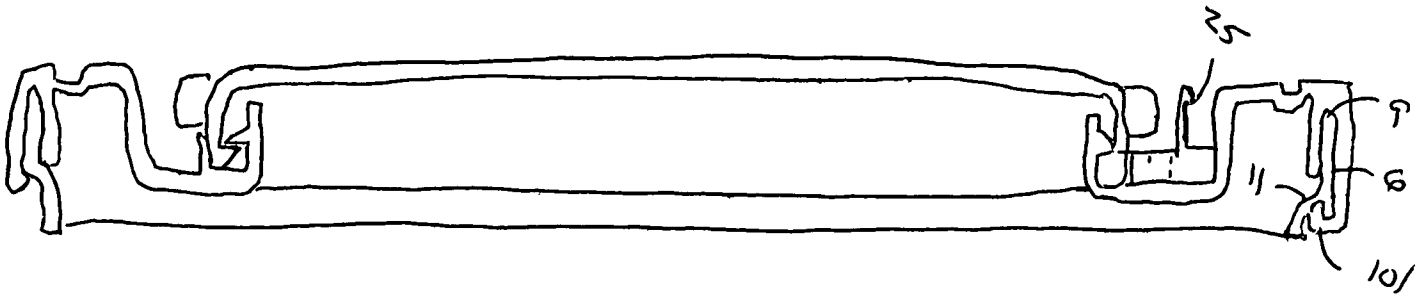
FIG. 5 is a cross-sectional view taken substantially along line 5-5 of FIG. 4.

Referring to the drawings in greater detail, and more particularly to FIGS. 1 and 3, the container and lid assembly of the present invention comprises, a rectangular container 1 having a rectangular closure 2 provided with a central circular opening 3 surrounded by at least one, if not a pair of radially spaced annular walls 4 and 5. The closure 2 is provided with a depending skirt portion 6 extending around the periphery thereof and a depending peripheral wall 7 spaced inwardly from the skirt portion 6 to provide a tapered channel 8 for receiving the upper edge portion 9 of the container 1, as shown in FIG. 5. While a rectangular container is shown and described in the images, it can also be understood that other shapes could be employed as well as and/or the traditional cylindrical style shape of containers. The opening 3 also need not be centrally disposed for all embodiments.

The skirt portion 6 of the rectangular closure 2 may preferably be provided with a plurality of peripherally spaced resilient fingers 10, FIGS. 1, 2 and 5, having hook-like ends 10' depending below the lower edge of skirt portion 6, and adapted to engage within a groove 11, as shown in FIGS. 3 and 5, formed between the container 1 and the upper edge portion 9 thereof, whereby the closure 2 may be tightly and releasably snapped onto the container 1. Thin vertical cuts 6' through skirt portion 6 separate the sides of fingers 10 from the skirt portion 6 and render the fingers 10 resilient. Slot openings 6" may be provided in the top of rectangular closure 2 to accommodate a mold part for forming the hooklike ends 10' on resilient fingers 10, during the molding process for rectangular closure 2. Other molding techniques may be employed whereby slots openings 6" are not provided for all embodiments, and/or other techniques could be utilized to retain the closure 2 to the container 1. The closure 2 and the lid 16 preferably cooperate with the container 1 in many embodiments to provide a closed configuration thereby enclosing at least a volume, if not goods internal to the container 1.

The first annular wall 4 may be provided with radially outwardly extending coordinated threads 12 which cooperate with a pair of inwardly extending coordinated threads 14 provided on a downwardly extending wall 17 of a lid 16. The threads 14 may be contained in a downwardly extending radially spaced channel 18 formed in the closure 2, which receive the downwardly depending wall 17 of the lid 16 when threaded onto the closure, as shown in FIGS. 1 and 5. Another annular wall could be provided such as is shown in U.S. Pat. No. 5,377,858 for some embodiments. Annular wall 5 may drop the elevation of the closure 2 at that point thereby creating upwardly facing channel 18 as well as potentially providing an ability for at least some embodiments to provide a relatively or substantially planar closure 2 with the lid 16 when the lid 16 is fully installed, such as is shown in FIG. 1. Other embodiments may have a lid 16 extending a distance above the closure 2 such as shown in the '858 patent or other designs and still other embodiments may have other constructions so that upper surface 36 of lid 17 is substantially planar and/or below an upper surface 37 of closure 2. Channel 18 may have base 41 and be formed by walls, first wall, upwardly extending wall 4 and base 41.

Figure 4:
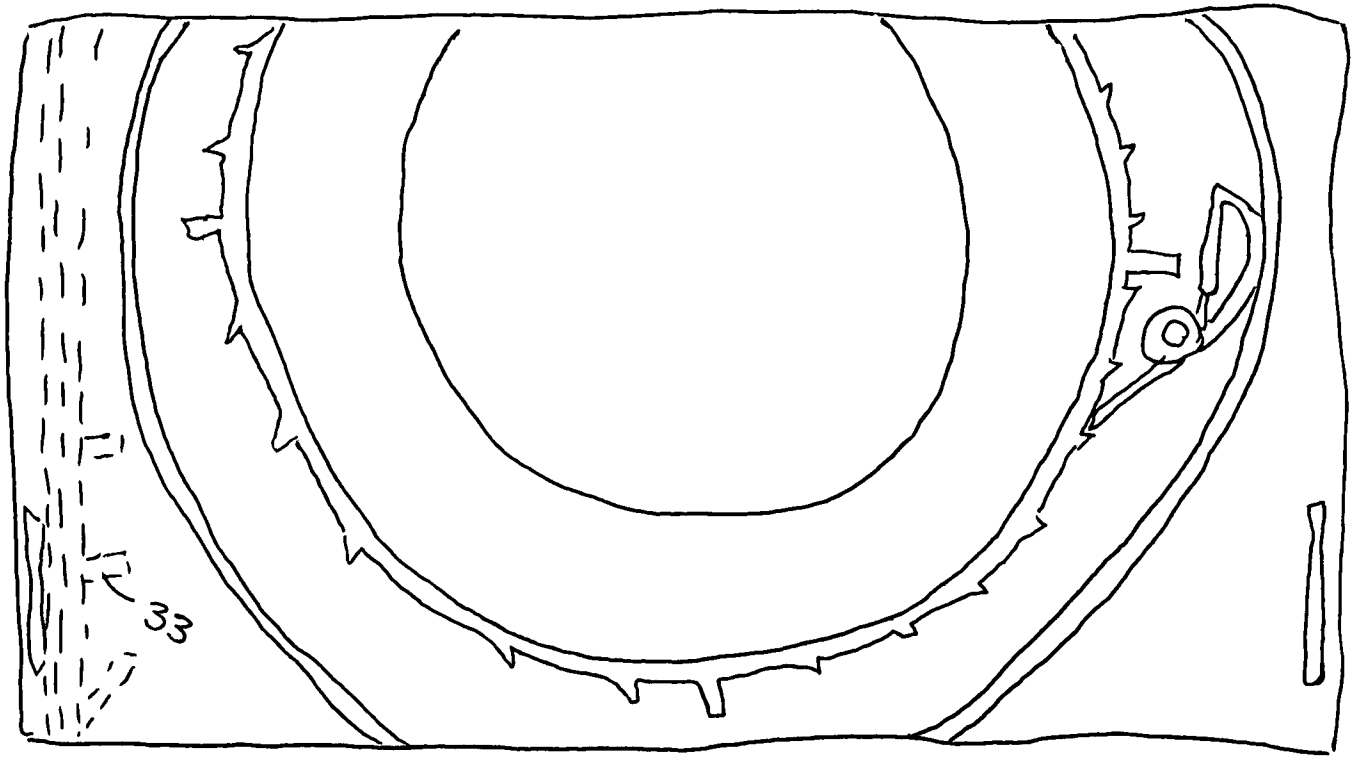
FIG. 4 is a fragmentary, top elevational view of the container and lid assembly shown in FIG. 1.

As will be seen in FIGS. 4 and 5, a resiliently biased locking member 19, of the type disclosed in my aforementioned patents, or of other constructions, whether biased or not, may be positioned in the channel 18 or elsewhere, and pivotally connected as at pivot 21 to the lid 16. The locking member 19 may include a lever arm 22 biased by an arcuate spring member 23, such as against wall 5 or otherwise, and so that at least one of a plurality of teeth 24 provided on or from the outer surface of the wall 17 also referred to as a stop, to thereby lock the lid 16 onto, or relative to, the closure 2 in a locked configuration. The locking lever 19 may also provided with a thumb engaging portion 25 for moving the lever arm 22 in a counter-clockwise direction away from engagement with the teeth 24, whereby the lid 16 can be manually unscrewed from the closure 2 in an unlocked configuration. Other locking members 19 of various constructions can be used with other embodiments. Teeth may be ramped such as shown in the '384 patent or otherwise constructed.

To facilitate the manipulation of the lid 16 onto and off of the closure 2, the lid 16 may be provided with corrugated surfaces as at 26 and/or tabs 27 to thereby provide gripping surfaces. Tabs 27 may particularly be helpful when the lid 16 is planar and/or below an upper surface 37 of the closure 2. Teeth 24 preferably terminate a distance below an upper surface 36 of the lid 16 and may extend from bottom 38 of the wall 17 such as about half way up wall 17 or other distance and/or have other configurations in other embodiments. They may or may not circumnavigate the lid 16 as illustrated.

Figure 2:
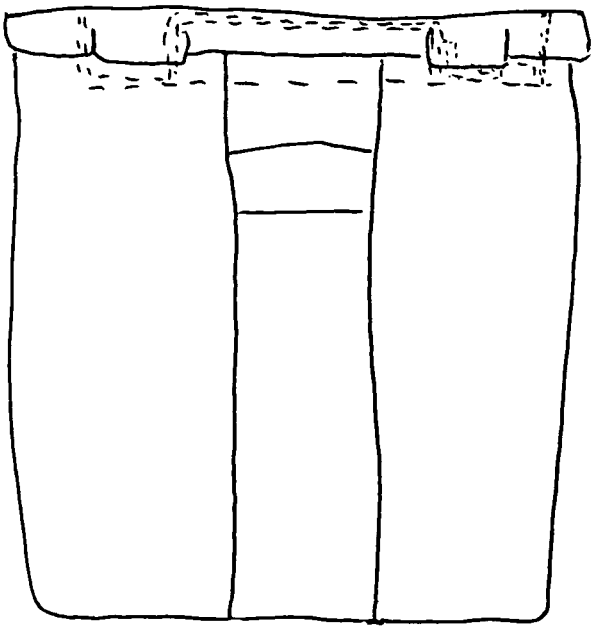
FIG. 2 is a side elevational view of the container and lid assembly shown in FIG. 1.

As will be seen in FIGS. 1, and 2, the side walls 39 of the containers may be tapered to facilitate nesting empty containers for shipment, or the like. Two opposite side walls of containers 1 can be provided with integral handles 30 aligned with a longitudinally extending recess 31. When stacked, the bottom edge of the handle 30 of the top container may contact the upper edge 9 of the next adjacent lower container. By providing the recesses 31 in the container side walls, the contact surface area may be reduced between nesting container, and an air passage is provided to thereby facilitate removing the containers from the nested position as is known in the art.

To complete the structural description of at least some embodiments of the container and lid assembly of the present invention, as will be seen in FIG. 3, short diagonal side webs 32 may be provided along the peripheral edge portion of the container 1 and possibly integral with the bottom 33 of the container for centering the container on top of the lid 16 of the next adjacent lower container when stacking. When assembled containers are stacked on top of one another, the bottom edge 34 of the top container 1 may rests on the flat reinforced ribs 35 of the top of closure 2 of the bottom container, as shown in FIG. 3, if provided or on at least one of an upper surface 36 the lid 16 and/or upper surface 37 of the closure 2.

From the above description it will be appreciated by those skilled in the art, that the construction and arrangement of the container 1 and lid assembly 16 of many embodiments of the present invention provide a container configured to maximize use of pallet space, and having a lid assembly positioned inwardly of the side walls of the container so that when placing a plurality of containers in side-by-side relationship, or when stacking the containers, the lid assembly 16 on each container is spaced inwardly from the side wall of the adjacent container, to thereby prevent damage to the lid assembly by the adjacent container during shipment and storage. A relatively large central circular opening for the container can be provided with this construction, which is protected by a child resistant lid assembly. Smaller lids can be used in other embodiments and rectangular shapes are not required for all embodiments. Furthermore, the taper of the side walls of the containers can facilitate nesting empty containers for some embodiments, and the longitudinal recesses 31 if formed in the walls of each container 1 beneath integral handles can facilitate sliding the empty inner container outwardly from the empty outer container because the contact wall surface area between adjacent containers can be reduced, thereby reducing the functional resistance to sliding movement between the containers. When full or when the closure 2 and lid assembly 16 are placed on the containers 1, the container can be stacked. The diagonal webs 32 center the container on top to straddle the lid on the next adjacent lower container, and if utilized, the bottom edge 34 of the container on top can rest on a reinforced area 35 on the closure 2 of the next adjacent lower container for some embodiments.

The terms and expression which have been employed herein are used as terms of description and not of limitation, and there is no intention, in the use of such terms and expressions, of excluding any equivalents of the features shown and described or portions thereof, but it is recognized that various modifications are possible within the scope of the invention claimed.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

The invention claimed is:

1. A container having a locking lid assembly comprising, a container having an open end, a closure removably connected to the open end of said container, an opening provided in said closure, a lid removably mounted on said closure for closing said opening, said closure provided with at least a first annular wall surrounding said opening, outwardly directed threads provided on the first annular wall cooperating with inwardly directed threads provided on a downwardly extending wall of said lid, whereby the lid is threadably connected to said closure, and a resiliently biased locking member movably connected to said closure and engageable with a radially outwardly directed stop on an exterior portion of the lid to secure the lid over the opening in the closure in a locked configuration.

2. A container and lid assembly according to claim 1, wherein an upper edge portion of the container is provided with a downwardly directed groove, the closure having a skirt portion, a plurality of peripherally spaced resilient fingers provided in said skirt portion engageable with said downwardly directed groove, whereby the closure is releasably snapped onto the container.

3. A container and lid assembly according to claim 1, wherein a plurality of radially outwardly directed teeth are provided on a radially outward exterior surface of the wall of a lid with at least one being the stop, and said resiliently biased locking member engaging at least one of said teeth to lock the lid to the closure in a locked configuration.

4. A container and lid assembly according to claim 3, wherein the locking member comprises a lever arm pivotally connected to the closure, a spring member biasing a free end of said lever arm into engagement with at least one of said teeth in the locked configuration, a thumb engaging portion on the opposite end of said lever arm for moving said free end of the lever arm in a direction away from engagement with the teeth to an unlocked configuration, whereby the lid can be manually unscrewed from the closure.

5. A container and lid assembly according to claim 1, wherein the closure has a downwardly depending wall forming an upwardly facing channel with the first wall, and the locking member is located in the channel.

6. A container and lid assembly according to claim 5, wherein the first wall of the closure is upwardly extending from a base of the channel.

7. A container and lid assembly according claim 5, further comprising a thumb engaging portion on the locking members for releasing the locking member from the lid.

8. A container and lid assembly according to claim 7, wherein the thumb engaging of the locking member is opposite a pivot from a lever arm which engages at least one tooth of a plurality of teeth in the locked configuration.

9. A container having a child resistant lid assembly comprising, a container having a side wall and an open end, a closure connected to the open end of said container, an opening provided in said closure, a first annular wall on said closure surrounding said opening and positioned inwardly of the side wall of the container and below the open end of the container, threads provided on a radially exterior side of said first annular wall, a lid having inwardly directed threads cooperating with the threads on said first annular wall to threadably connect said lid to said closure for closing said opening, and a resiliently biased locking member pivotally connected to said closure and engageable with a portion of the lid to lock the lid relative to the opening of the closure in a locked configuration.

10. A container and lid assembly according to claim 9, wherein said open end of said container has an upper edge portion provided with a groove, the closure having a skirt portion, a plurality of peripherally spaced resilient fingers provided in said skirt portion engageable with said groove, whereby the closure is releasably snapped onto the container.

11. A container and lid assembly according to claim 9, wherein the opening is centrally disposed on the closure.

12. A container and lid assembly according to claim 9, wherein the container has a substantially rectangular cross section.

13. A container and lid assembly according to claim 9, wherein the lid and closure provide substantially planar upper surfaces when the lid is installed and in the locked configuration.

14. A container and lid assembly according to claim 9, wherein the first wall is upwardly extending from the closure.

15. A container and lid assembly according to claim 9, wherein the lid has a downwardly extending wall with a plurality of outwardly directed teeth extending radially outwardly from the wall with the at least one of the teeth cooperating with the locking member in locked configuration.

16. A container and lid assembly according to claim 15, in which the plurality of teeth extend no more than about half way up the wall.

17. A container and lid assembly according to claim 15, wherein the downwardly extending wall of the lid has the threads inwardly directed therefrom.

18. A container and lid assembly according to claim 15, wherein the locking member comprises a lever arm pivotally connected to the closure, a spring member biasing a free end of said lever arm into engagement with at least one of said teeth in the locked configuration, a thumb engaging portion on the opposite end of said lever arm for moving said free end of the lever arm in a direction away from engagement with the teeth to an unlocked configuration, whereby the lid can be manually unscrewed from the closure.

19. A container and lid assembly according to claim 15, wherein the plurality of teeth provided on the outer surface of the downwardly extending wall of the lid extend from a bottom of the wall and terminate below an upper surface of the lid.

20. A container and lid assembly according to claim 19, in which the plurality of teeth extend no more than about half way up the wall.

* * * * *